US009362680B2

(12) United States Patent
Kao et al.

(10) Patent No.: US 9,362,680 B2
(45) Date of Patent: Jun. 7, 2016

(54) ELECTRICAL PLUG CONNECTOR

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Wen-Hsien Tsai, New Taipei (TW); Alan MacDougall, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/755,416

(22) Filed: Jun. 30, 2015

(65) Prior Publication Data

US 2015/0380870 A1 Dec. 31, 2015

(30) Foreign Application Priority Data

| | | |
|---|---|---|
| Jun. 30, 2014 | (TW) | 103211622 A |
| Jul. 8, 2014 | (TW) | 103123538 A |
| Nov. 27, 2014 | (TW) | 103141242 A |

(51) Int. Cl.

| | |
|---|---|
| ***H01R 13/648*** | (2006.01) |
| ***H01R 13/6583*** | (2011.01) |
| ***H01R 13/6593*** | (2011.01) |
| *H01R 24/60* | (2011.01) |
| *H01R 107/00* | (2006.01) |

(52) U.S. Cl.
CPC ..... *H01R 13/6583* (2013.01); *H01R 13/6593* (2013.01); *H01R 24/60* (2013.01); *H01R 2107/00* (2013.01)

(58) Field of Classification Search
USPC ..... 439/607.27, 607.53, 607.55
See application file for complete search history.

(56) References Cited

U.S. PATENT DOCUMENTS

| | | | | |
|---|---|---|---|---|
| 7,695,304 | B2 * | 4/2010 | Chiang | H01R 13/506 439/353 |
| 8,021,188 | B1 * | 9/2011 | Ma | H01R 12/722 439/607.55 |

* cited by examiner

*Primary Examiner* — Tho D Ta
(74) *Attorney, Agent, or Firm* — Muncy, Geissler, Olds & Lowe, P.C.

(57) ABSTRACT

An electrical plug connector includes a metallic shell, and two conductive contact members. The two conductive contact members are respectively received in a top concave region and a bottom concave region of the insulated housing. When the electrical plug connector is inserted into a metallic shell of the electrical receptacle connector, each conductive contact members of the electrical plug connector comes in contact with the inner surface of the metallic shell of the electrical receptacle connector and a low-impedance grounding path is established between the metallic shell of the electrical plug connector and the metallic shell of the mating electrical receptacle connector through each conductive contact member.

20 Claims, 11 Drawing Sheets

| | | | | | | | | | | | |
|---|---|---|---|---|---|---|---|---|---|---|---|
| GND | RX2+ | RX2− | VBUS | RFU | D− | D+ | CC1 | VBUS | TX1− | TX1+ | GND |
| GND | TX2+ | TX2− | VBUS | CC2 | D+ | D− | RFU | VBUS | RX1− | RX1+ | GND |

121

122

Fig. 2C

ELECTRICAL PLUG CONNECTOR

CROSS-REFERENCES TO RELATED APPLICATIONS

This non-provisional application claims priority under 35 U.S.C. §119(a) on Patent Application No. 103211622, 103123538, and 103141242, filed in Taiwan, R.O.C. on 2014 Jun. 30, 2014 Jul. 8, and 2014 Nov. 27, the entire contents of which are hereby incorporated by reference.

FIELD OF THE INVENTION

The instant disclosure relates to an electrical connector, and more particularly to a shielded electrical plug connector having a conductive contact member which allows a low-impedance grounding path to be established between a metallic shell of the electrical plug connector and a metallic shell of the mating electrical receptacle connector through the conductive contact member.

BACKGROUND

Currently, the increase in the functionality of various electronic devices is driving the demand for smaller and smaller devices that are easier and more convenient for users to carry and use. This causes many electrical/electronic components within the device to be located closer together. This increases the possibility that various electronic components in the device will suffer from electromagnetic interference (EMI) or radio frequency interference (RFI) either from RF components such as the antenna, microphone components, RF power amplifiers, etc and subsystems in the device and/or from external sources. The high speed electrical transmission in these devices can produce electromagnetic emissions, which may leak from the connection between the plug connector and its mating connector. These emissions can cause problems in high speed signal transmissions in that they can negatively influence wireless communication between two devices.

When electrical connectors are made smaller, the conductive contacts or pins of electrical connectors are brought closer to each other thereby increasing the electromagnetic coupling between the electrical connectors. An increase in electromagnetic coupling between differential signal pairs may generate unwanted noise or crosstalk that negatively affects the performance of the electrical connector and increase EMI/RFI leakage. One particular concern regarding electrical connector is reducing electromagnetic interference (EMI) or radio frequency interference (RFI) so as to meet the relevant EMI regulations or RFI regulations. There is a need not only to minimize the EMI or RFI of electrical connectors but also to contain the EMI or RFI of the host system in which the electrical connector assembly is mounted, regardless of whether a plug connector is inserted into a receptacle connector.

In conventional designs, EMI shielding is achieved using the metallic shell. The metallic shell is typically stamped to form spring fingers. These spring fingers are then bent to form finger contacts. These finger contacts form an electrical connection with a shield on the connector insert and hold the connector insert when it is placed in a connector receptacle. EMI leakage still occurs in such structure. However, due to the increasing of the speed rate of signals being transmitted through the electrical connector assemblies when a plug connector is inserted into a receptacle connector, the EMI shielding or RFI shielding provided by conventional shell is proving to be inadequate.

SUMMARY OF THE INVENTION

In view of the above problem, the instant disclosure provides an electrical plug connector, which includes an insulated housing, a plurality of upper-row elastic terminals, a plurality of lower-row elastic terminals, a metallic shell, and two conductive contact members. The insulated housing are divided into an upper member and a lower member. The insulated housing further defines a plug opening and a mating room. The mating room is defined and formed between the upper member and the lower member. The plug opening is located at the front of the upper member and the lower member and communicates with the mating room. The top side of the upper member and the bottom side of the lower member further respectively define a top and a bottom concave regions which are symmetrically disposed at the top side of the upper member and the bottom side of the lower member. The depth of each concave region is greater than or equal to the thickness of each conductive contact member. Each conductive contact member is received in the corresponding concave region. The two recessed portions are respectively concaved in the inner surfaces of the top and the bottom concave regions. The two recessed portions also respectively penetrate through the inner surfaces of the top and the bottom concave regions and are adjacent to the plug opening. The upper-row elastic terminals are held in the upper member. The upper-row elastic terminals may be assembled in the upper member or inserted molding in the upper member. The lower-row elastic terminals are held in the lower member. The lower-row elastic terminals also may be assembled in the lower member or inserted molding in the lower member. The upper-row elastic terminals and the lower-row elastic terminals partly project into the mating room. The metallic shell defines a receiving cavity configured to receive and enclose the insulated housing, the upper-row elastic terminals, and the lower-row elastic terminals. The metallic shell further has a plurality of holes located at the front of the top side or the bottom side thereof and adjacent to the opening. Each conductive contact member is fabricated of stamped and formed sheet material to define an elongated sheet portion, a resilient portion extending forward from the elongated sheet portion, and a plurality of dome-shaped contact portions perpendicularly formed from the resilient portion. Each resilient portion is cantilevered and suspended above the corresponding recessed portion and configured to provide flexing of the corresponding conductive contact member up or down to an angle from a natural state. The natural state refers to the state of the contact member when it is not acted on by an external force. Each dome-shaped contact portion is aligned with each hole of the metallic shell when the conductive contact members and the metallic shell are properly overlapped. Each dome-shaped contact portion is protruded outward over the circumferential edge of each hole of the metallic shell when the conductive contact members and the metallic shell are properly overlapped and joined. Each conductive contact member further includes a conductive contact plate formed in a region of the conductive contact member, which contacts the inner surface of the metallic shell of the electrical plug connector. Each conductive contact plate is cantilevered and inclined sideways by cutting and raising a portion of each conductive contact member. When the electrical plug connector is fully or partially inserted into a metallic shell of an electrical receptacle connector, the dome-shaped contact portions of the electrical plug connector come in contact with an inner surface of the metallic shell of the electrical receptacle connector. Since the dome-shaped contact portions of the conductive contact members are in contact with the metallic shell of the electrical receptacle connector, a low-impedance grounding path can be effectively established between the metallic shell of the electrical plug connector and the metallic shell of the electrical receptacle connector through the conductive contact member such that the electromagnetic interference (EMI) can be further reduced.

When the electrical plug connector is inserted into the electrical receptacle connector, the dome-shaped contact portions are biased or compressed by the inner surface of the metallic shell of the electrical receptacle connector, thereby causing the dome-shaped contact portions partially or entirely being deflected inward underneath the circumferential edges of the holes of the metallic shell. The dome-shaped contact portions and the metallic shell of the electrical receptacle connector may cover the holes during the mating between the electrical plug connector and the electrical receptacle connector such that any EMI or RFI leakage from the holes is attenuated, thereby preventing from EMI and RFI negatively influence signal transmissions between the mating connectors. Before the mating of the electrical plug connector and the electrical receptacle connector, each dome-shaped contact portion may cover each hole of the metallic shell because each dome-shaped contact portion is protruded outward over the circumferential edge of each hole of the metallic shell. Therefore, the configuration of the conductive contact members of the electrical plug connector could be provided to enhance the EMI and RFI shielding effect.

Detailed description of the characteristics and the advantages of the instant disclosure is shown in the following embodiments, the technical content and the implementation of the instant disclosure should be readily apparent to any person skilled in the art from the detailed description, and the purposes and the advantages of the instant disclosure should be readily understood by any person skilled in the art with reference to content, claims and drawings in The instant disclosure.

BRIEF DESCRIPTION OF THE DRAWINGS

The instant disclosure will become more fully understood from the detailed description given herein below for illustration only, and thus are not limitative of The instant disclosure, and wherein:

FIG. 2C is a schematic configuration diagram of plug terminals of the electrical plug connector formed in an exemplary embodiment shown in FIG. 2B;

DETAILED DESCRIPTION

Figure 1:
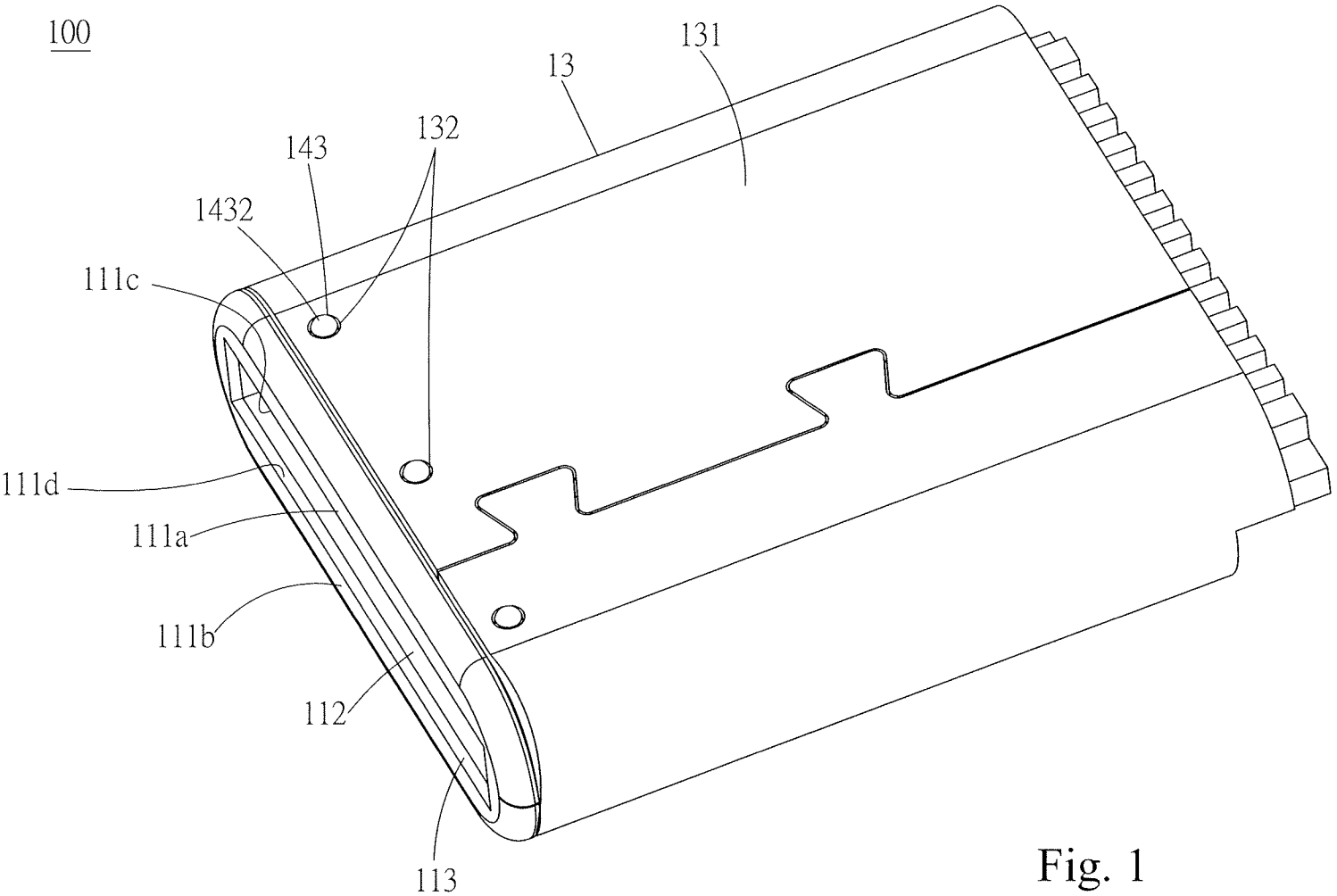
FIG. 1 illustrates a perspective view of an electrical plug connector formed in an exemplary embodiment according to the instant disclosure.
Figure 2:
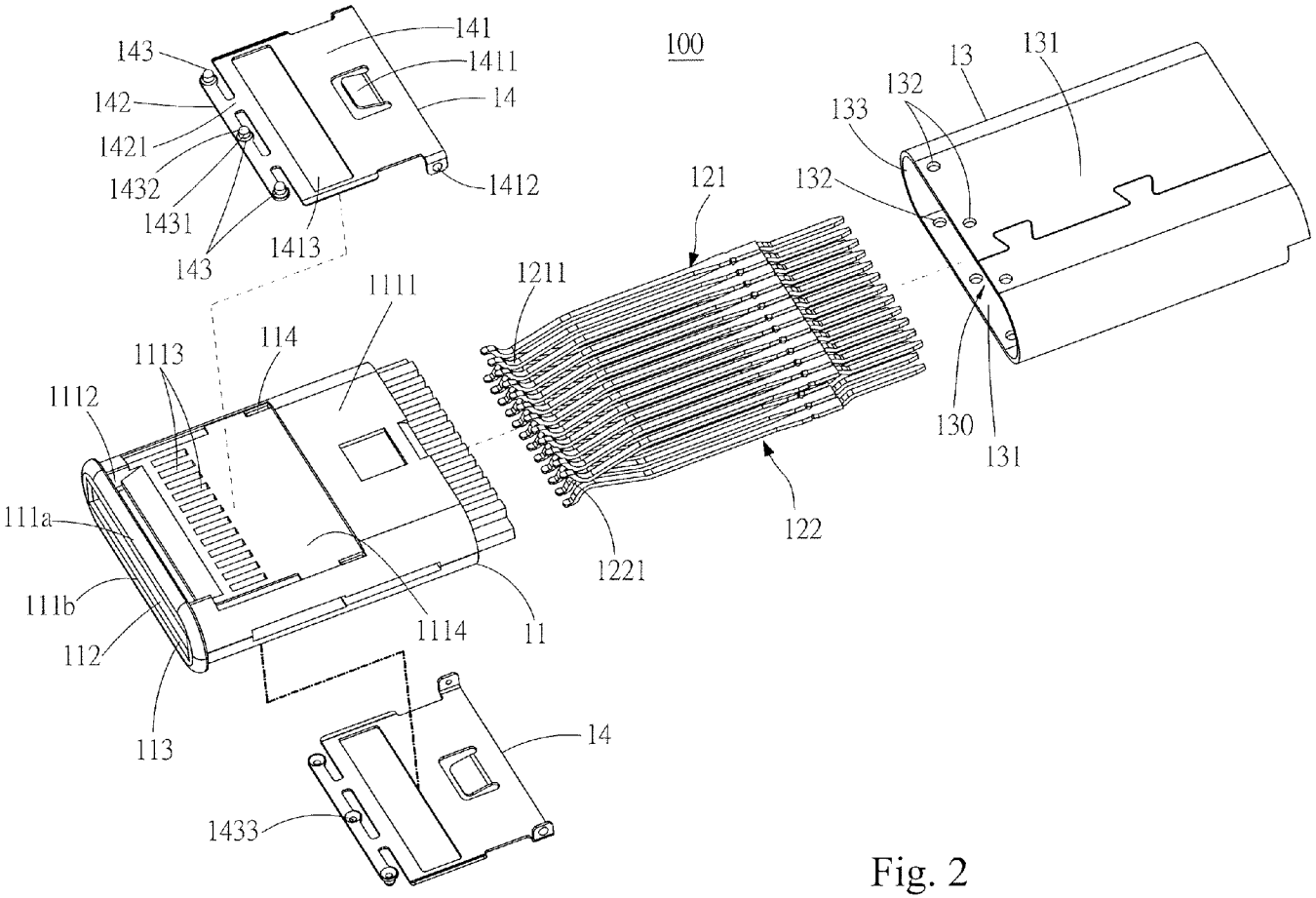
FIG. 2 illustrates an exploded perspective view of an electrical plug connector formed in an exemplary embodiment according to the instant disclosure.
Figure 3:
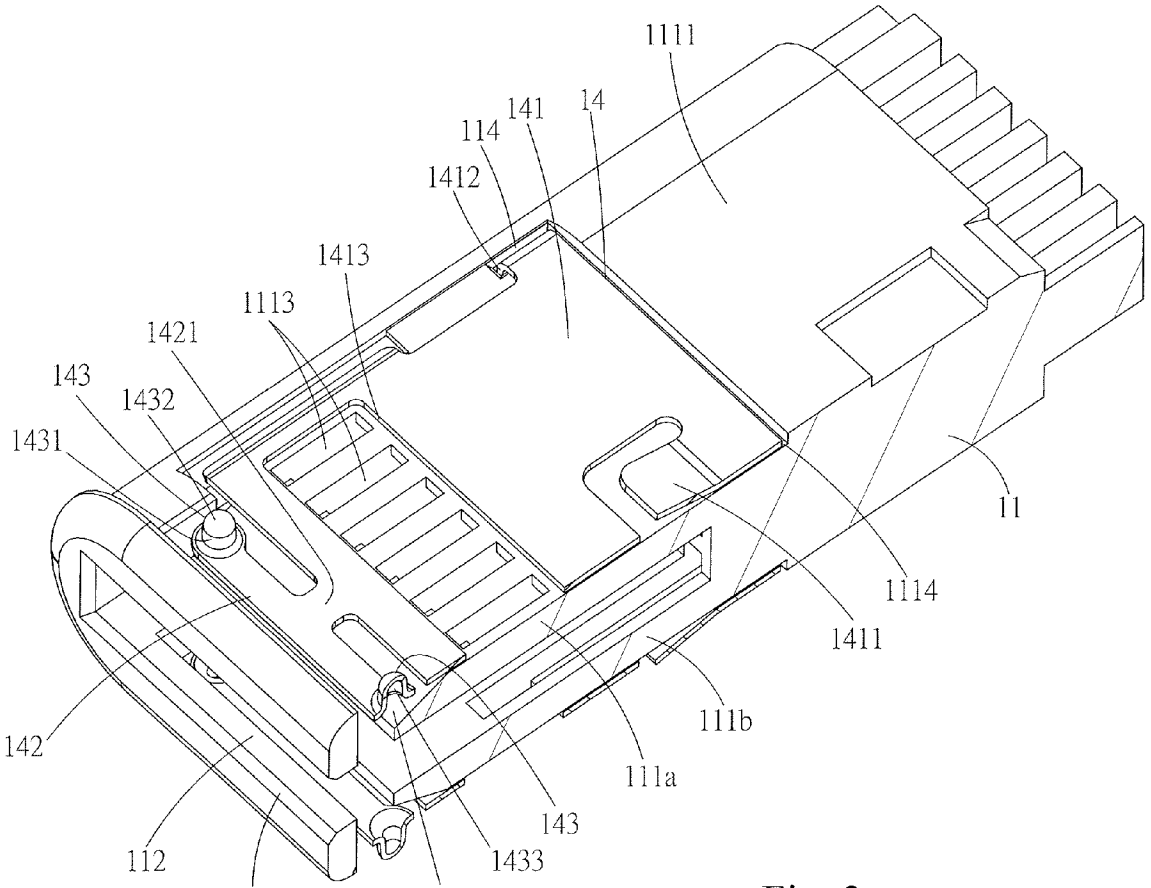
FIG. 3 illustrates a sectional perspective view (1) of the electrical plug connector formed in an exemplary embodiment shown in FIG. 1 and FIG. 2 according to the instant disclosure.
Figure 4:
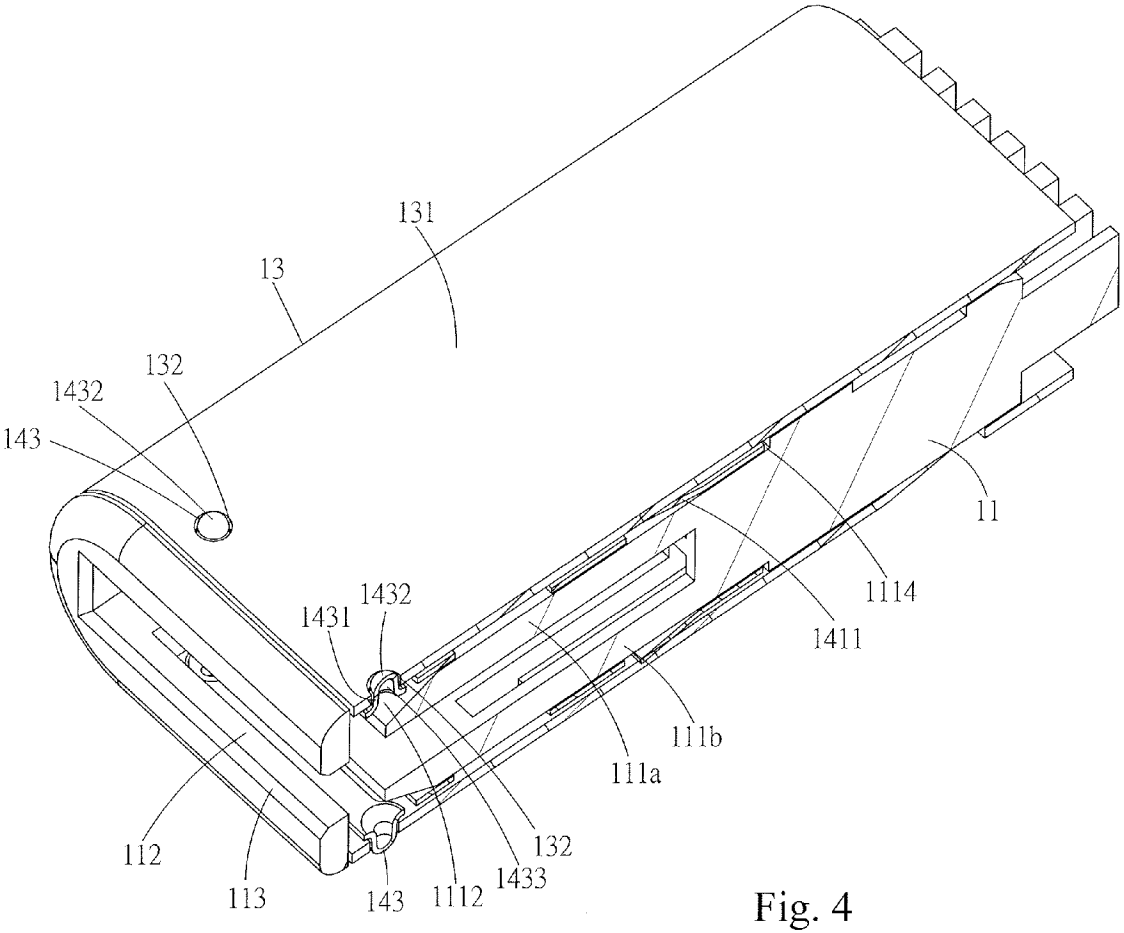
FIG. 4 illustrates sectional perspective view (2) of the electrical plug connector formed in an exemplary embodiment shown in FIG. 1 and FIG. 2 according to the instant disclosure, where the electrical plug connector is devoid of the metallic shell.

FIG. 1 illustrates a perspective view of an electrical plug connector formed in an exemplary embodiment according to the instant disclosure. FIG. 2 illustrates an exploded perspective view of an electrical plug connector formed in an exemplary embodiment. FIG. 3 illustrates a sectional perspective view (1) of the electrical plug connector formed in an exemplary embodiment shown in FIG. 1 and FIG. 2. FIG. 4 illustrates sectional perspective view (2) of the electrical plug connector formed in an exemplary embodiment shown in FIG. 1 and FIG. 2, where the electrical plug connector is devoid of the metallic shell. Referring to FIG. 1, FIG. 2, FIG. 3, and FIG. 4, in this embodiment, the electrical plug connector 100 can provide a reversible or dual orientation USB Type-C connector interface and pin assignments, i.e. a USB Type-C plug connector, which is a new USB connector ecosystem that addresses the evolving needs of platforms and devices while retaining all of the functional benefits of USB that form the basis for this most popular of computing device interconnects. The USB Type-C Connector Specification defines a new receptacle and plug that are compatible with existing electrical and functional specifications of USB interface such as USB 3.0 or USB 2.0 specifications. Accordingly, USB plug connector according to the instant disclosure can have a 180 degree symmetrical, dual or double orientation design and pin assignments which enables the plug connector to be inserted into a corresponding receptacle connector in either of two intuitive orientations, i.e. in either upside-up or upside-down directions. As shown in FIGS. 1, 2, 3, and 4, the electrical plug connector 100 includes an insulated housing 11, a plurality of upper-row elastic terminals 121, a plurality of lower-row elastic terminals 122, a metallic shell 13, and two conductive contact members 14.

Referring to FIG. 2, FIG. 3, and FIG. 4, the insulated housing 11 are divided into an upper member 111*a* and a lower member 111*b*. The upper member 111*a* and the lower member 111*b* of the insulated housing 11 are respectively insert molded or the like. The upper member 111*a* of the insulated housing 11 defines an upper base portion and an upper tongue portion extending forward from the upper base portion in the rear-to-front direction. The lower member 111*b* of the insulated housing 11 defines a lower base portion and a lower tongue portion extending forward from the lower base portion in the rear-to-front direction. The upper base portion of the upper member 111*a* is engaged with the lower base portion of the lower member 111*b* for production of an unitary member, named as the insulated housing 11. A bottom side of the upper tongue portion of the upper member 111*a* and a top side of the lower tongue portion of the lower member 111*b* are parallel to each other. A mating room 112 is defined and formed between the upper tongue portion of the upper member 111*a* and the lower tongue portion of the lower member 111*b*. The bottom side of the upper tongue portion of the upper member 111*a* could be named as an upper mating face 111*c* and the top side of the lower tongue portion of the lower member 111*b* could be named as a lower mating face 111*d*. The upper mating face 111*c* is faced toward the lower mating face 111*d* and corresponds to the lower mating face 111*d*. A top side of the upper member 111*a* and a bottom side of the lower member 111*b* are named as an outer surface 1111. In addition, two recessed portions 1112 are symmetrically disposed at the top side of the upper member 111*a* and the bottom side of the lower member 111*b* respectively. In this exemplary embodiment, the recessed portions 1112 are located at a front of the outer surface 1111. In other exemplary embodiment, the recessed portions 1112 may be located at a rear of the outer surface 1111 or a middle region between the front and the rear of the outer surface 1111. In this embodiment, the top side of the upper member 111*a* and the bottom side of the lower member 111*b* further respectively define a top and a bottom concave regions 1114 which are symmetrically disposed at the top side of the upper member 111*a* and the bottom side of the lower member 111*b*. The depth of each concave region 1114 is greater than or equal to the thickness of each conductive contact member 14. Each conductive contact member 14 is received in the corresponding concave region 1114. The insulated housing 11 further defines a plug opening 113 which is located at the front of the upper member 111*a* and the lower member 111*b* and communicates with the mating room 112. In addition, the plug opening 113 could be formed in the shape of, for example, oblong or rectangular. The two recessed portions 1112 are respectively concaved in the corresponding inner surfaces of the top and the bottom concave regions 1114. The two recessed portions 1112 also respectively penetrate through the inner surfaces of the top and the bottom concave regions 1114 and are adjacent to the plug opening 113.

Figure 2A:
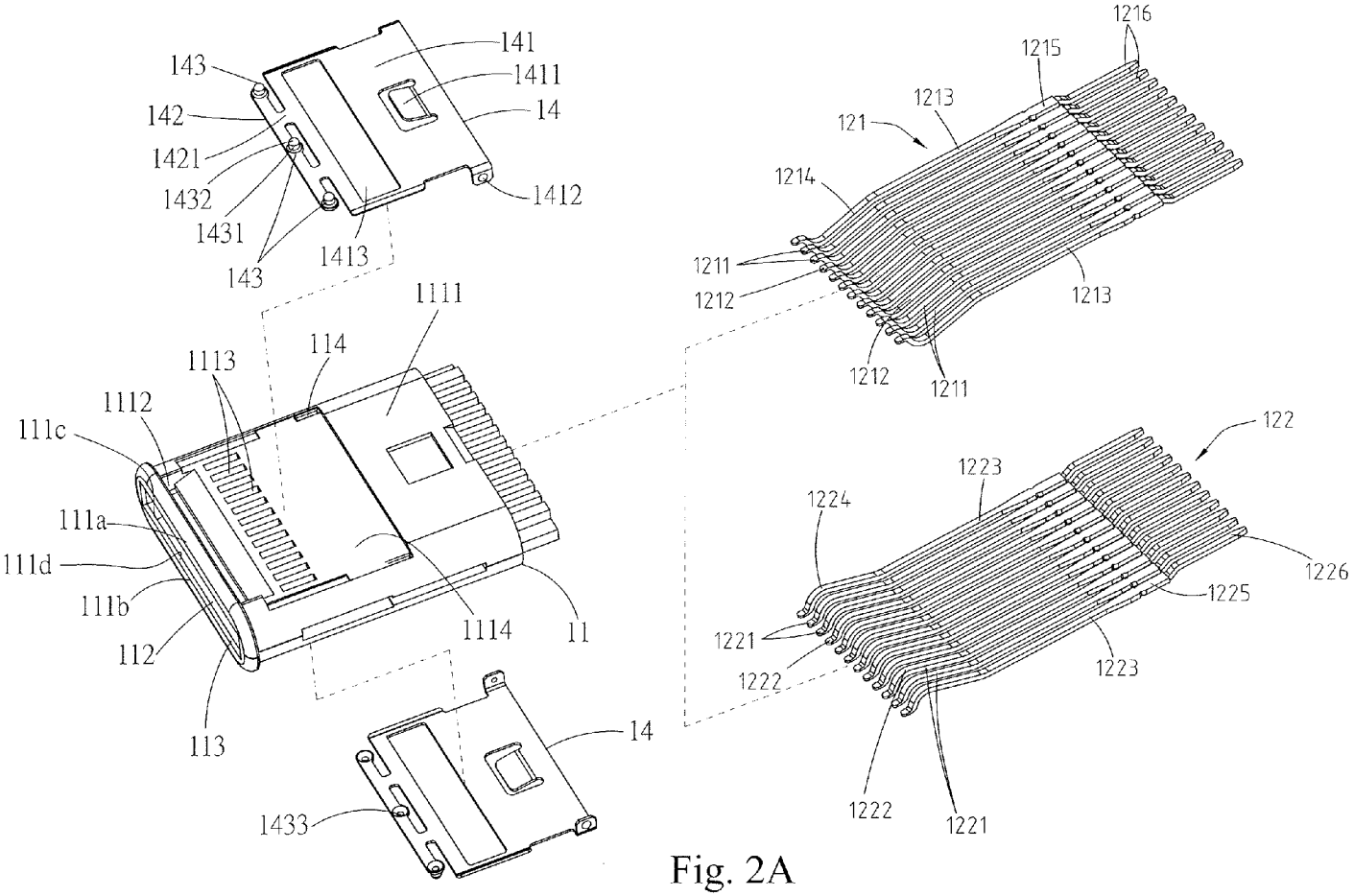
FIG. 2A illustrates a partial exploded perspective view of the electrical plug connector formed in an exemplary embodiment according to the instant disclosure.
Figure 2B:
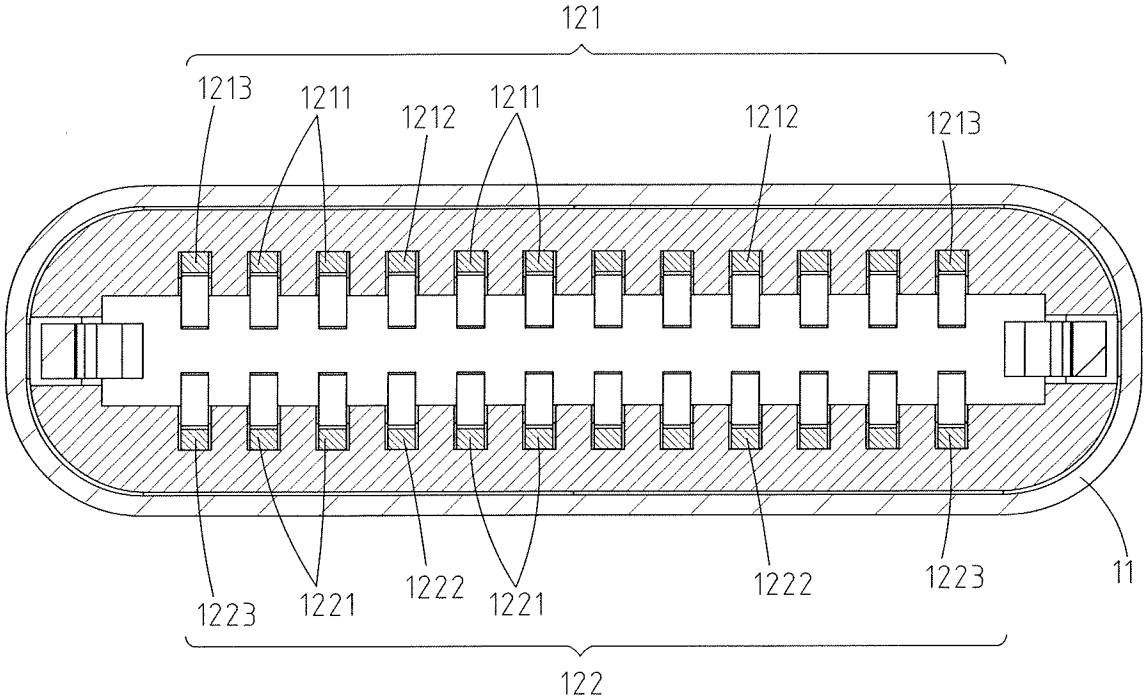
FIG. 2B illustrates a sectional view of the electrical plug connector formed in an exemplary embodiment according to the instant disclosure.

Referring to FIG. 2, FIG. 3, and FIG. 4, each upper-row elastic terminal 121 defines a body portion 1215, a flexible contact portion 1214 extending forward from the body portion 1215 in the rear-to-front direction, and a tail portion 1216 extending backward from the body portion 1215 in the front-to-rear direction. The body portions 1215 of the upper-row elastic terminals 121 are held in the upper member 111*a*. Additionally, the upper-row elastic terminals 121 could be assembled in the upper member 111*a* or inserted molding in the upper member 111*a*. Each lower-row elastic terminal 122 also defines a body portion 1225, a flexible contact portion 1224 extending forward from the body portion 1225 in the rear-to-front direction, and a tail portion 1226 extending backward from the body portion 1225 in the front-to-rear direction. The body portions 1225 of the lower-row elastic terminals 122 are held in the lower member 111*b*. In other words, the lower-row elastic terminals 122 could be assembled in the lower member 111*b* or inserted molding in the lower member 111*b*. The flexible contact portions 1214 of the upper-row elastic terminals 121 and the flexible contact portions 1224 of the lower-row elastic terminals 122 partly project into the mating room 112. The flexible contact portions 1214 of the upper-row elastic terminals 121 are partly exposed upon the upper mating face 111*c* of the upper tongue portion and the flexible contact portions 1224 of the lower-row elastic terminals 122 are partly exposed upon the lower mating face 111*d* of the lower tongue portion. The upper-row elastic terminals 121 may include two pairs of upper differential pairs 1211 for signal transmission (USB 3.0 signals), two ground terminals 1213, and two power terminals 1212. The two ground terminals 1213 of the upper-row elastic terminals 121 are located at two opposite sides of the upper-row elastic terminals 121 and each of upper differential pairs 1211 is located between one of the power terminals 1212 and one of the ground terminals 1213. The lower-row elastic terminals 122 may include two pairs of lower differential pairs 1221 for signal transmission (USB 3.0 signals), two ground terminals 1223, and two power terminals 1222. The two ground terminals 1223 of the lower-row elastic terminals 122 are located at two opposite sides of the lower-row elastic terminals 122 and each of lower differential pairs 1221 is located between one of the power terminals 1223 and one of the ground terminals 1222. In some embodiments, as shown in FIG. 2A to 2C, the upper-row elastic terminals 121 comprise, from right to left, a ground terminal 1213 (Gnd), a first upper differential pair (TX1+−) 1211, a second upper differential pair (D+−) 1211, a third upper differential pair (RX2+−) 1211, two power terminals 1212 (Power/VBUS) between the three pairs of upper differential pairs, a retain terminal (RFU), (the retain terminal and a configuration channel 1 (CC1) are respectively arranged between the power terminals 1212 and the second upper differential pair (D+−) 1211), and another ground terminal 1213 (Gnd). In addition, the lower-row elastic terminals 122 comprise, from left to right, a ground terminal 1223 (Gnd), a first lower differential pair (TX2+−) 1221, a second lower differential pair (D+−) 1221, a third lower differential pair (RX1+−) 1221, power terminals 1222 (Power/VBUS) between the three pairs of lower differential pairs, a retain terminal (RFU), (the retain terminal and a configuration channel 2 (CC2) are respectively arranged between the power terminals 1222 and the second lower differential pair (D+−) 1221), and another ground terminal 1223 (Gnd).

Please refer to FIG. 2A and FIG. 2B and FIG. 2C, in which embodiment it is understood that from the arrangements of the upper-row elastic terminals 121 and lower-row elastic terminals 122, the upper-row elastic terminals 121 and the lower-row elastic terminals 122 are respectively at the upper mating face 111*c* of the upper member 111*a* and the lower mating face 111*d* of the lower member 111*b*. Additionally, pin-assignments of the upper-row elastic terminals 121 and the lower-row elastic terminals 122 are point-symmetrical with a central point of the receiving cavity 130 as the symmetrical center. Here, point-symmetry means that after the upper-row elastic terminals 121 (or the lower-row elastic terminals 122), are rotated by 180 degrees with the symmetrical center as the rotating center, the upper-row elastic terminals 121 and the lower-row elastic terminals 122 are overlapped. That is, the rotated upper-row elastic terminals 121 are arranged at the position of the original lower-row elastic terminals 122, and the rotated lower-row elastic terminals 122 are arranged at the position of the original upper-row elastic terminals 121. Accordingly, the plug connector 100 according to the instant disclosure can have a 180 degree symmetrical, dual or double orientation design and pin assignments which enables the plug connector to be inserted into a corresponding receptacle connector in either of two intuitive orientations, i.e. in either upside-up or upside-down directions. In other words, the upper-row elastic terminals 121 and the lower-row elastic terminals 122 are arranged upside down, and the pin assignments of the upper-row elastic terminals 121 are left-right reversal with respect to that of the lower-row elastic terminals 122. The electrical plug connector 100 is inserted into an electrical receptacle connector with a first orientation where the lower mating face 111*d* of the lower member 111*b* is facing up, for transmitting first signals. Conversely, the electrical plug connector 100 is inserted into the electrical receptacle connector with a second orientation where the lower mating face 111*d* of the lower member 111*b* is facing down, for transmitting second signals. Furthermore, the specification for transmitting the first signals is conformed to the specification for transmitting the second signals. Note that, the inserting orientation of the electrical plug connector 100 is not limited by the instant disclosure.

Referring to FIG. 2, FIG. 3, and FIG. 4, the metallic shell 13 defines a receiving cavity 130 that is configured to receive and enclose the insulated housing 11, the upper-row elastic terminals 121, and the lower-row elastic terminals 122. In this embodiment, the metallic shell 13 may be formed of a one-piece member or multi-piece members. The metallic shell 13 defines an opening 133 which is formed in the shape of, for example, oblong or rectangular and communicates with the receiving cavity 130 of the metallic shell 13. The metallic shell 13 defines a top, a bottom, and two lateral sides, named as an outer wall 131. The metallic shell 13 further has a plurality of holes 132 which are located at the front of the top side or the bottom side thereof and adjacent to the opening 133.

Referring to FIG. 2, FIG. 3, and FIG. 4, each conductive contact member 14 is fabricated of stamped and formed sheet material to define an elongated sheet portion 141, a resilient portion 142 extending forward from the elongated sheet portion 141, and a plurality of dome-shaped contact portions 143 perpendicularly formed from the resilient portion 142. The contact portions 143 may have other shapes. For example, the contact portions 143 may have other rounded or contoured, or other types of shapes. Each resilient portion 142 is cantilevered and suspended above the corresponding recessed portion 1112 and configured to provide flexing of the corresponding conductive contact member 14 up or down to an angle from a natural state. The natural state refers to the state of the contact member 14 when it is not acted on by an external force. Each dome-shaped contact portion 143 is aligned with each hole 132 of the metallic shell 13 when the conductive contact members 14 and the metallic shell 13 are properly overlapped. Each dome-shaped contact portion 143 is protruded outward over the circumferential edge of each hole 132 of the metallic shell 13 when the conductive contact members 14 and the metallic shell 13 are properly overlapped and joined. In this embodiment, each conductive contact member 14 further includes a conductive contact plate 1411 formed in a region of the conductive contact member 14, which contacts the inner surface of the metallic shell 13. Each conductive contact plate 1411 is cantilevered and inclined sideways and upward/downward by cutting and raising a portion of the conductive contact member 14.

Figure 5:
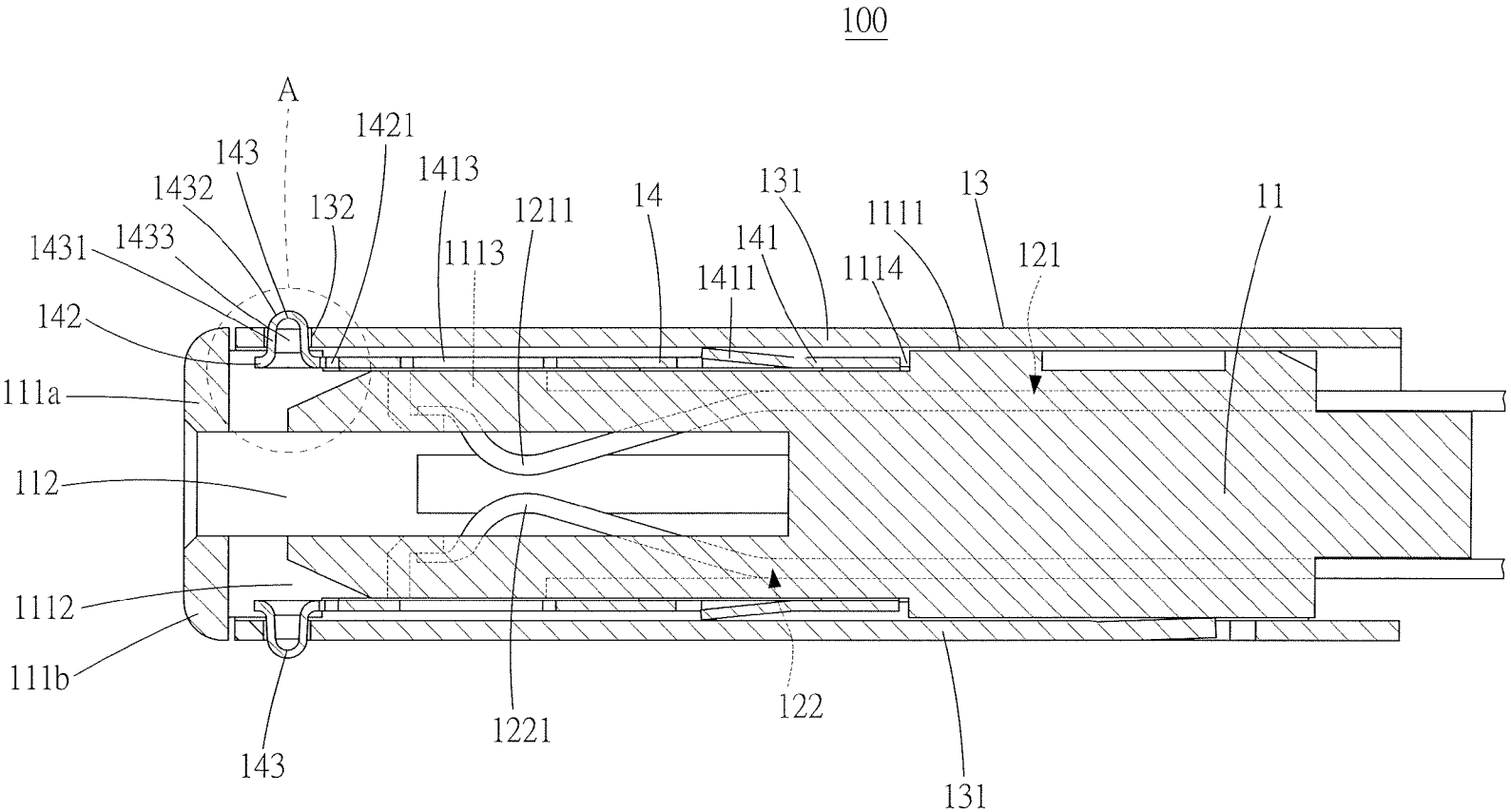
FIG. 5 illustrates a lateral sectional view of the electrical plug connector according to the instant disclosure.
Figure 6:
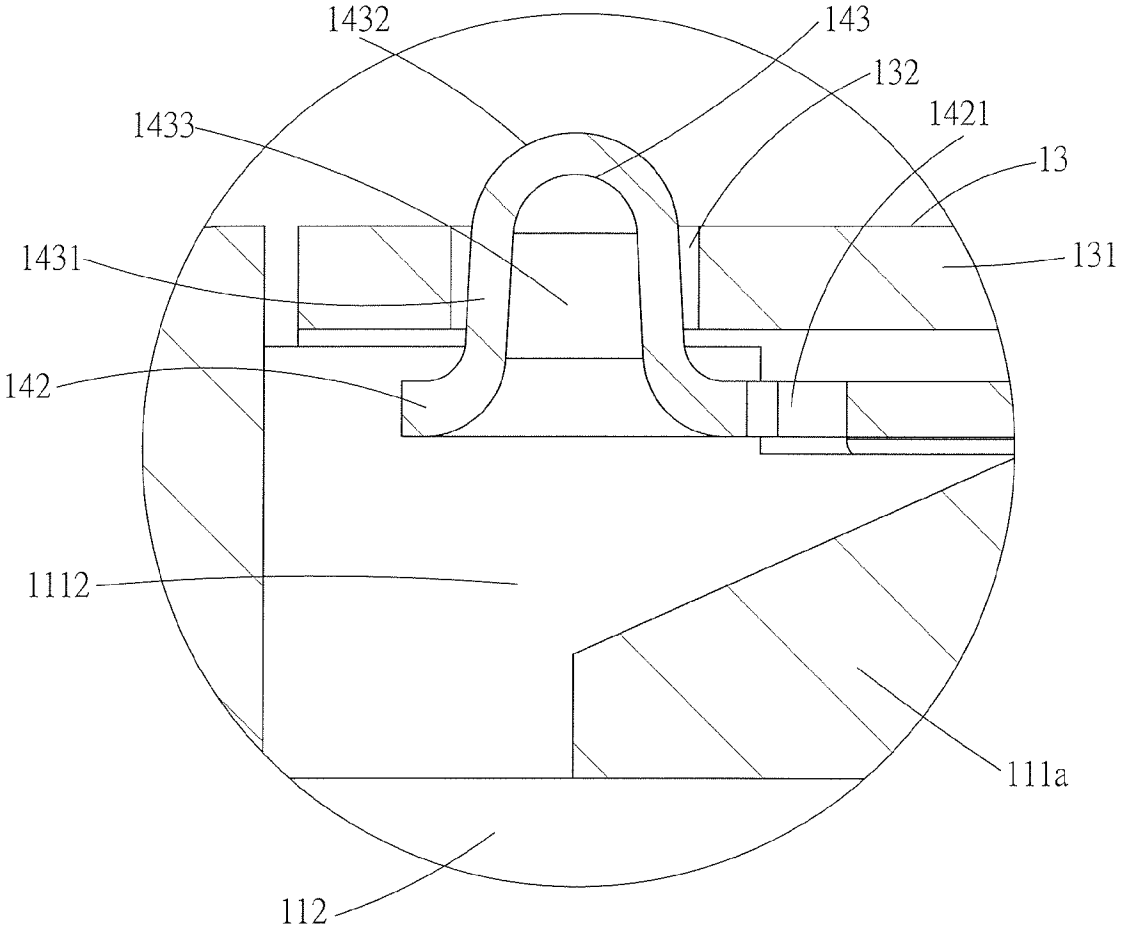
FIG. 6 illustrates a partial enlarged view of a portion "A" of the electrical plug connector shown in FIG. 5.
Figure 7:
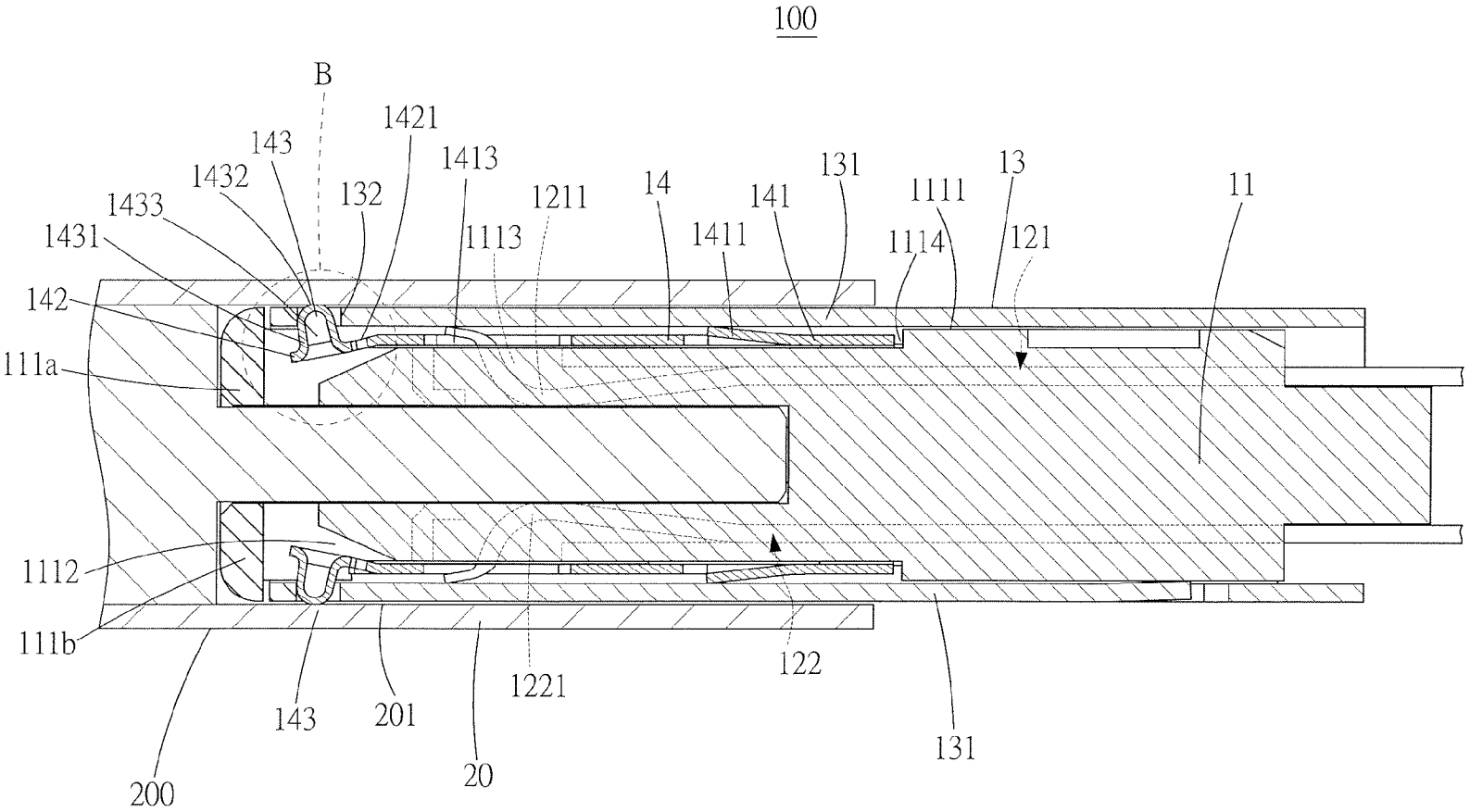
FIG. 7 illustrates a lateral sectional view of the electrical plug connector inserted into an electrical receptacle connector according to the instant disclosure.
Figure 8:
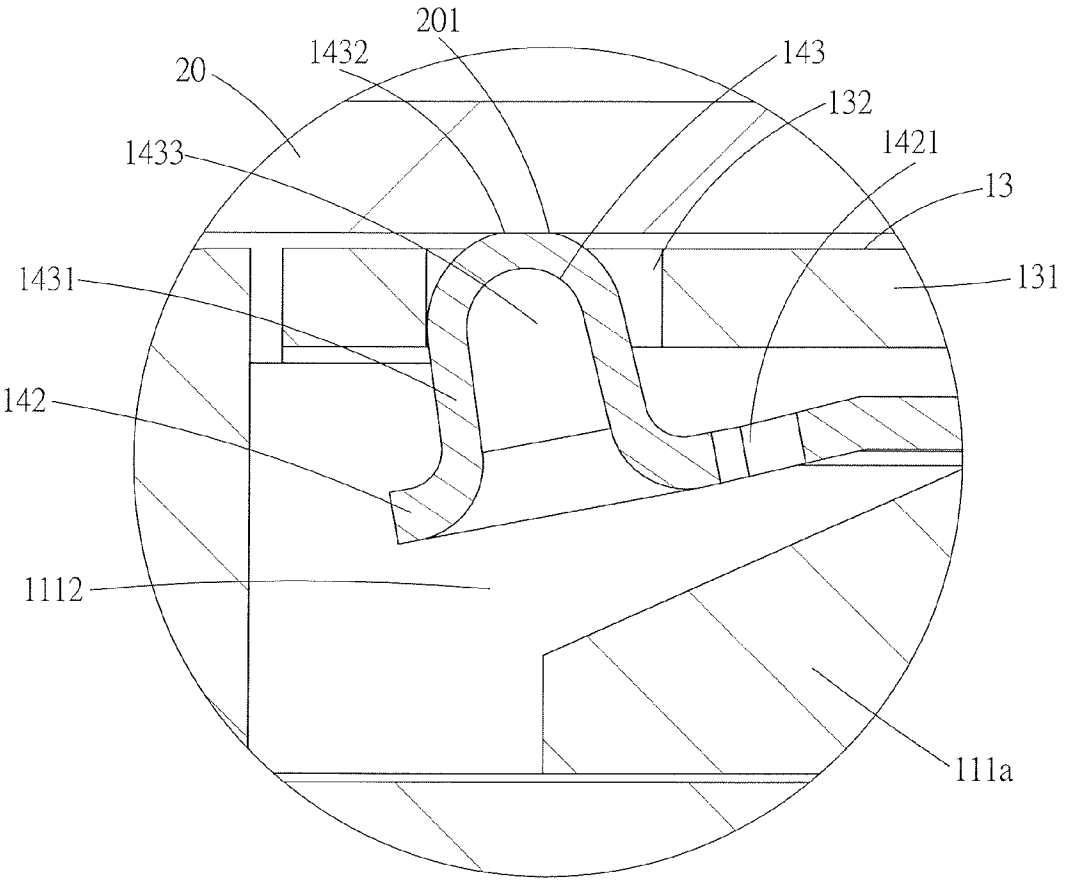
FIG. 8 illustrates a partial enlarged view of a portion of "B" of the electrical plug connector shown in FIG. 7.

FIG. 5 illustrates a lateral sectional view of the electrical plug connector 100, FIG. 6 illustrates a partial enlarged view of a portion "A" of the electrical plug connector 100 shown in FIG. 5, FIG. 7 illustrates a lateral sectional view of the electrical plug connector 100 inserted into an electrical receptacle connector according to the instant disclosure, and FIG. 8 is a partial enlarged view of a portion "B" of the electrical plug connector 100 shown in FIG. 7. Referring to FIG. 5, FIG. 6, FIG. 7, and FIG. 8, when the electrical plug connector 100 is fully or partially inserted into a metallic shell 20 of an electrical receptacle connector 200, the dome-shaped contact portions 143 of the electrical plug connector 100 come in contact with an inner surface 201 of the metallic shell 20. Since the dome-shaped contact portions 143 of the conductive contact members 14 are in contact with the metallic shell 20 of the electrical receptacle connector 200, a low-impedance grounding path can be effectively established between the metallic shell 13 of the electrical plug connector 100 and the metallic shell 20 of the electrical receptacle connector 200 through the conductive contact member 14 such that the electromagnetic interference (EMI) can be further reduced.

Also, the resilient portions 142 allow deflection of the conductive contact members 14, thereby allowing movement of the dome-shaped contact portions 143 when the electrical plug connector 100 is inserted into or removed from the electrical receptacle connector 200. In other words, before the electrical plug connector 100 is inserted into the electrical receptacle connector 200, the dome-shaped contact portions 143 and the resilient portions 142 are not deflected and acted on by an external force such that the dome-shaped contact portions 143 are located at a natural position. The natural position refers to the position of the dome-shaped contact portions 143 when the dome-shaped contact portions 143 and the resilient portions 142 are not acted on by an external force. In other words, the dome-shaped contact portions 143 are entirely protruded outward over the circumferential edges of the holes 132 of the metallic shell 13 when the resilient portions 142 are not deflected and the dome-shaped contact portions 143 are located at the natural position. When the electrical plug connector 100 is inserted into the electrical receptacle connector 200, the dome-shaped contact portions 143 are biased or compressed by the inner surface 201 of the metallic shell 20 of the electrical receptacle connector 200, thereby causing the dome-shaped contact portions 143 partially or entirely being deflected inward underneath the circumferential edges of the holes 132 of the metallic shell 13. When the dome-shaped contact portions 143 are deflected inward underneath the circumferential edges of the holes 132 of the metallic shell 13, the dome-shaped contact portions 143 are deflected from the natural position toward a mating position and the dome-shaped contact portions 143 are in contact with the inner surface 201 of the metallic shell 20 of the electrical receptacle connector 200. The mating position refers to the position of the dome-shaped contact portions 143 when the dome-shaped contact portions 143 and the resilient portions 142 are biased or compressed by the inner surface 201 of the metallic shell 20 of the electrical receptacle connector 200. In other words, when the electrical plug connector 100 is fully inserted into the electrical receptacle connector 200, the dome-shaped contact portions 143 are located at the mating position. Thus, when the electrical plug connector 100 is inserted into the electrical receptacle connector 200, the dome-shaped contact portions 143 and the metallic shell 20 of the electrical receptacle connector 200 may cover the holes 132 such that any EMI or RFI leakage from the holes 132 is attenuated, thereby preventing from EMI and RFI negatively influence signal transmissions between the connectors.

Referring to FIG. 5, FIG. 6, FIG. 7, and FIG. 8, when the dome-shaped contact portions 143 are biased or compressed by the inner surface 201 of the metallic shell 20 of the electrical receptacle connector 200, the dome-shaped contact portions 143 may be entirely or partially moved inward underneath the circumferential edges of the holes 132 of the metallic shell 13. It depends on the distance between the inner surface 201 of the metallic shell 20 of the electrical receptacle connector 200 and the outer wall 131 of the metallic shell 13 of the electrical plug connector 100 that the dome-shaped contact portions 143 are entirely or partially moved inward underneath the circumferential edges of the holes 132 of the metallic shell 13. That is, the dome-shaped contact portions 143 may almost entirely move inward underneath the circumferential edges of the holes 132 of the metallic shell 13 when the distance between the inner surface 201 of the metallic shell 20 of the electrical receptacle connector 200 and the outer wall 131 of the metallic shell 13 of the electrical plug connector 100 equals to zero. On the other hand, the dome-shaped contact portions 143 may be partially moved inward underneath the circumferential edges of the holes 132 of the metallic shell 13 when the distance between the inner surface 201 and the outer wall 131 is greater than zero. In other words, parts of the dome-shaped contact portions 14 are protruded outward over the circumferential edges of the holes 132 of the metallic shell 13 and the other parts of the dome-shaped contact portions 14 are moved inward underneath the circumferential edges of the holes 132 of the metallic shell 13. In practice, during the mating of the electrical receptacle connector 200 and the electrical plug connector 100, the distance between the inner surface 201 of the metallic shell 20 of the electrical receptacle connector 200 and the outer wall 131 of the metallic shell 13 of the electrical plug connector 100 is very small, for example about 0.05 millimeter or 0.1 millimeter, but does not equal to zero.

Referring to FIG. 5, FIG. 6, FIG. 7, and FIG. 8, in addition, when the inner surface 201 of the metallic shell 20 of the electrical receptacle connector 200 biases or compresses the dome-shaped contact portions 143 of the electrical plug connector 100, the dome-shaped contact portions 143 and the resilient portions 142 are deflected toward the recessed portions 1112 of the insulated housing 11, thereby allowing the movement of the dome-shaped contact portions 143 and the resilient portions 142 in the space within the interiors of the recessed portions 1112. When the electrical plug connector 100 is removed from the electrical receptacle connector 200, the resilient portions 142 return back to the horizontal, i.e. the natural position and the tips of the dome-shaped contact portions 143 are also protruded outward over the circumferential edges of the holes 132 of the metallic shell 13.

Referring to FIG. 5, FIG. 6, FIG. 7, and FIG. 8, each dome-shaped contact portion 143 includes a column portion 1431 and a dome-shaped portion 1432. The dome-shaped contact portion 143 is like a hemispherical roof or a structure of similar form. When the electrical plug connector 100 is inserted into the electrical receptacle connector 200, the inner surface 201 of the metallic shell 20 of the electrical receptacle connector 200 biases or compresses the dome-shaped portions 1432 such that the resilient portions 142 are deflected toward the recessed portions 1112, thereby allowing the movement of the column portions 1431 and the dome-shaped portions 1432 in the space within the interiors of the recessed portions 1112. The inherent resilience of the resilient portions 142 cause the dome-shaped portions 1432 continuously in contact with the inner surface 201 of the metallic shell 20. The inherent resilience of the resilient portions 142 also cause the dome-shaped portions 1432 back to the natural position when the electrical plug connector 100 is removed from the electrical receptacle connector 200.

Referring to FIG. 5, FIG. 6, FIG. 7, and FIG. 8, each dome-shaped contact portion 143 further defines an interior cavity 1433 located inside the corresponding column portion 1431 and the corresponding dome-shaped portion 1432. Processes for creating such a dome-shaped contact portion 143 can include applying a die and stamp to a resilient portion 142, single or double impact extrusion, or a progressive deep draw process. In other words, the dome-shaped contact portions 143 may be formed by applying a progressive deep drawn process, a die and stamp, or single or double impact extrusion to the resilient portions 142 for creating the column portions 1431 and the dome-shaped portions 1432 of the dome-shaped contact portions 143.

Referring to FIG. 5, FIG. 6, FIG. 7, and FIG. 8, each resilient portion 142 further includes a plurality of strip-shaped portions 1421 extended from the corresponding elongated sheet portion 141 in the rear-to-front direction. In addition, the adjacent strip-shaped portions 1421 are separated by a distance along a transverse direction perpendicular to the rear-to-front direction. When the electrical receptacle connector 200 is inserted into the electrical receptacle connector 200 and the inner surface 201 of the metallic shell 20 biases or compresses the dome-shaped contact portions 143, the dome-shaped contact portions 143 and the resilient portions 142 are deflected, thereby allowing the movement of the dome-shaped contact portions 143 and the resilient portions 142 between the natural position and the mating position.

Referring to FIG. 5, FIG. 6, FIG. 7, and FIG. 8, the upper member 111*a* or the lower member 111*b* defines two catching grooves 114 disposed at the top side of the upper member 111*a* or the bottom side of the lower member 111*b*. Each conductive contact member 14 further includes two mounting legs 1412 bilaterally downward or upward extending from the two opposite lateral rear sides of the elongated sheet portion 141 for fastening to the corresponding catching grooves 114 so as to effectively mount the conductive contact members 14 onto the upper member 111*a* and the lower member 111*b*.

In the instant disclosure, a plurality of dome-shaped contact portions are protruded outward over the holes of the metallic shell before an electrical plug connector is inserted into an electrical receptacle connector. After the electrical plug connector is inserted into the electrical receptacle connector, the dome-shaped contact portions of the conductive contact members are in contact with a metallic shell of the electrical receptacle connector such that a low-impedance grounding path can be effectively established between the metallic shell of the electrical plug connector and the metallic shell of the electrical receptacle connector, thereby mitigating the electromagnetic interference (EMI) so as to meet the relevant EMI regulations.

Also, when the dome-shaped contact portions are located at the natural position, that is, the electrical plug connector is not inserted into the electrical receptacle connector, the dome-shaped contact portions are protruded outward over the holes of the metallic shell, and the dome-shaped contact portions and the conductive contact members may cover the holes. When the dome-shaped contact portions are located at the mating position, that is, when the electrical plug connector is inserted into the electrical receptacle connector, the dome-shaped contact portions are partially or entirely deflected inward underneath the circumferential edges of the holes and parts of dome-shaped contact portions and the metallic shell of the electrical plug connector may also cover the holes to obtain a desirable shielding effect. The RFI shielding effect is enhanced by the use of the dome-shaped contact portions of the conductive contact members of the electrical plug connector, which tends to seal off the holes of metallic shell before the mating between the electrical plug connector and the electrical receptacle connector. The metallic shell of the electrical receptacle connector may cover the holes of metallic shell of the electrical plug connector during the mating between the electrical plug connector and the electrical receptacle connector, thereby enhancing the RFI shielding effect. Therefore, the use of the configuration of the dome-shaped contact portions of the conductive contact members of the electrical plug connector tends to enhance the EMI and RFI shielding effect.

While The instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

a metallic shell defining a receiving cavity and comprising a plurality of holes located thereon;

an insulated housing received in the receiving cavity, wherein the insulated housing comprises an upper member defining a top concave region, a lower member defining a bottom concave region, and defines a mating room being located between the upper member and the lower member;

a plurality of upper-row elastic terminals held in the upper member, wherein each upper-row elastic terminal partly projects into the mating room;

a plurality of lower-row elastic terminals held in the lower member, wherein each lower-row elastic terminal partly projects into the mating room; and two conductive contact members respectively received in the top concave region and the bottom concave region, wherein each of the conductive contact members comprises:

a elongated sheet portion;

a resilient portion extending forward from the elongated sheet portion; and a plurality of dome-shaped contact portions perpendicularly formed from the resilient portion, wherein the dome-shaped contact portions are located at a natural position and each dome-shaped contact portion is protruded outward the circumferential edge of each hole of the metallic shell before the electrical plug connector is inserted into an electrical receptacle connector, and the dome-shaped contact portions are located at a mating position and the dome-shaped contact portions are biased an inner surface of a metallic shell of the electrical receptacle connector, thereby causing each resilient portion being deflected and each dome-shaped contact portion being underneath the circumferential edge of each hole of the metallic shell after the electrical plug connector is inserted into the electrical receptacle connector.

2. The electrical plug connector according to claim 1, wherein each dome-shaped contact portion is aligned with each hole of the metallic shell and protruded outward over the circumferential edge of each hole of the metallic shell when each conductive contact member and the metallic shell of the electrical plug connector are properly overlapped and joined.

3. The electrical plug connector according to claim 1, wherein each conductive contact member further comprises a conductive contact plate formed in a region of the conductive contact member, which contacts an inner surface of the metallic shell of the electrical plug connector.

4. The electrical plug connector according to claim 3, wherein each conductive contact plate is cantilevered and inclined sideways by cutting and raising a portion of each conductive contact member.

5. The electrical plug connector according to claim 4, wherein when the electrical plug connector is inserted into the metallic shell of the electrical receptacle connector, the dome-shaped contact portions come in contact with the inner surface of the metallic shell of the electrical receptacle connector.

6. The electrical plug connector according to claim 1, wherein each resilient portion further comprise a plurality of strip-shaped portions extended from the corresponding elongated sheet portion in the rear-to-front direction and the adjacent strip-shaped portions are separated by a distance along a transverse direction perpendicular to the rear-to-front direction.

7. The electrical plug connector according to claim 1, wherein each upper-row elastic terminal comprises a body portion, a tail portion extending backward form the body portion, and a flexible contact portion extending from the body portion and partly projecting into the mating room, and wherein each lower-row elastic terminal comprises a body portion, a tail portion extending backward form the body portion, and a flexible contact portion extending from the body portion and partly projecting into the mating room.

8. The electrical plug connector according to claim 7, wherein the body portions of the upper-row elastic terminals are held in the upper member and the body portions of the lower-row elastic terminals are held in the lower member.

9. The electrical plug connector according to claim 8, wherein the upper-row elastic terminals are assembled or inserted molding in the upper member.

10. The electrical plug connector according to claim 8, wherein the lower-row elastic terminals are assembled or inserted molding in the lower member.

11. The electrical plug connector according to claim 1, wherein the upper-row elastic terminals comprise:

two pairs of upper differential pairs for signal transmission;

two ground terminals located at two opposite sides of the upper-row elastic terminals; and two power terminals, wherein each of the upper differential pairs is located between one of the power terminals and one of the ground terminals.

12. The electrical plug connector according to claim 1, wherein the lower-row elastic terminals comprise:

two pairs of lower differential pairs for signal transmission;

two ground terminals located at two opposite sides of the lower-row elastic terminals; and two power terminals, wherein each of the lower differential pairs is located between one of the power terminals and one of the ground terminals.

13. The electrical plug connector according to claim 1, wherein the insulated housing further defines a plug opening which is located at the front of the upper member and the lower member and communicates with the mating room.

14. The electrical plug connector according to claim 13, wherein the upper member and the lower member further defines two recessed portions which are respectively concaved in the top concave region and the bottom concave region and are adjacent to the plug opening.

15. The electrical plug connector according to claim 14, wherein the two recessed portions respectively penetrate through the inner surfaces of the top and the bottom concave regions.

16. The electrical plug connector according to claim 14, wherein the dome-shaped contact portions and the resilient portions are deflected toward the corresponding recessed portions, thereby allowing the movement of the dome-shaped contact portions and the resilient portions in a space within the interiors of the corresponding recessed portions.

17. The electrical plug connector according to claim 1, wherein the upper member and the lower member respectively define two catching grooves respectively disposed at the top side of the upper member and the bottom side of the lower member, and wherein each conductive contact member further comprises two mounting legs bilaterally downward or upward extending from the two opposite lateral rear sides of the elongated sheet portion for fastening to the corresponding catching grooves so as to effectively mount the conductive contact members onto the upper member and the lower member.

18. The electrical plug connector according to claim 1, wherein the upper member defines an upper base portion and an upper tongue portion extending forward from the upper base portion in the rear-to-front direction, the lower member defines a lower base portion and a lower tongue portion extending forward from the lower base portion in the rear-to-front direction and the upper base portion of the upper member is engaged with the lower base portion of the lower member for production of an unitary member.

19. The electrical plug connector according to claim 18, wherein a bottom side of the upper tongue portion and a top side of the lower tongue portion are parallel to each other and the mating room is formed between the upper tongue portion and the lower tongue portion.

20. The electrical plug connector according to claim 1, wherein the electrical plug connector provides a 180 degree symmetrical, reversible or dual orientation connector interface and pin assignments which enables the electrical plug connector to be inserted into the corresponding electrical receptacle connector in either of two intuitive orientations.

* * * * *